US006631999B1

(12) United States Patent
Chang

(10) Patent No.: US 6,631,999 B1
(45) Date of Patent: Oct. 14, 2003

(54) WALL LAMP WITH A ROTATING INNER SHADE

(75) Inventor: Tony Chang, Taipei (TW)

(73) Assignee: Taitech International Corporation, Taipei (TW)

( * ) Notice: Subject to any disclaimer, the term of this patent is extended or adjusted under 35 U.S.C. 154(b) by 0 days.

(21) Appl. No.: 10/121,127

(22) Filed: Apr. 11, 2002

(51) Int. Cl.[7] ..... F21V 33/00

(52) U.S. Cl. ..... 362/96; 362/101; 362/351; 362/149; 362/801

(58) Field of Search ..... 362/96, 294, 351, 362/373, 374, 149, 218, 345, 437, 101, 801, 179, 181, 431, 441, 442

(56) References Cited

U.S. PATENT DOCUMENTS 2,840,689 A * 6/1958 Kazor ..... 362/35
3,162,367 A * 12/1964 Nowack ..... 239/19
3,686,494 A * 8/1972 Naylor ..... 40/441
4,816,973 A * 3/1989 Atalla et al. ..... 362/226
4,827,382 A * 5/1989 Feliks ..... 362/35

* cited by examiner

*Primary Examiner*—Sandra O'Shea
*Assistant Examiner*—John Anthony Ward

(57) ABSTRACT

A wall lamp with a rotating inner shade includes a lamp body having a housing and a shade attached to the housing. A stand is attached to the housing within and by means of the shade. An inner shade in balanced on a free end of the stand. The inner shade has a closed upper end and multiple blades formed on the upper end. A passage is defined adjacent blades. Hot air is generated by the burning light bulb and rises in the inner shade. The inner shade rotates when the hot air impinges the blades and passes through the passages. Consequently, the light radiated from the wall lamp is vivid.

6 Claims, 5 Drawing Sheets

WALL LAMP WITH A ROTATING INNER SHADE

BACKGROUND OF THE INVENTION

1. Field of the Invention

The present invention relates to a wall lamp, and more particularly to a wall lamp with a rotating inner shade.

2. Description of Related Art

With reference to FIG. 5, a conventional wall lamp in accordance with the prior art comprises a lamp body (70) and a shade (80) attached to the lamp body (70).

The lamp body (70) includes a housing (71) and a socket (72) extending up from the housing (71). A light bulb (73) is electrically mounted in the socket (72). A groove (74) is defined between the housing (71) and the socket (72).

The shade (80) includes a U-shaped flange (81) extending inward from the bottom of the shade (80) and forming a recess (83) in the bottom of the shade (80). An opening (82) is defined in the shade (80) for receiving the socket (72) and the light bulb (73). The flange (81) is inserted into and partially received in the groove (74) in the lamp body (70).

The shade (80) of the conventional wall lamp is attached to the lamp body (70) only by the flange (81) such that the shade (80) is easily detached from the lamp body (70) by a force applied laterally. Furthermore, light radiating from the conventional wall lamp is monotone because the shade (80) of the conventional wall lamp is fixed on the lamp body (70).

The present invention has arisen to mitigate and/or obviate the disadvantages of the conventional wall lamp.

SUMMARY OF THE INVENTION

The main objective of the present invention is to provide a wall lamp with a rotating inner shade.

To achieve the objective, the wall lamp in accordance with the present invention comprises a lamp body having a housing and a shade attached to the housing. A stand is attached perpendicular to the housing within the shade. An inner shade mounted around a free end of the stand. The inner shade has a closed upper end and multiple blades formed on the upper end. A passage is defined between adjacent blades. A burning light bulb will cause a raising hot air current to form in the inner shade. The inner shade rotates when the raising hot air current passes through the passages and impinges the blades. Consequently, the light radiated from the wall lamp is vivid.

Further benefits and advantages of the present invention will become apparent after a careful reading of the detailed description with appropriate reference to the accompanying drawings.

DETAILED DESCRIPTION OF THE INVENTION

Figure 1:
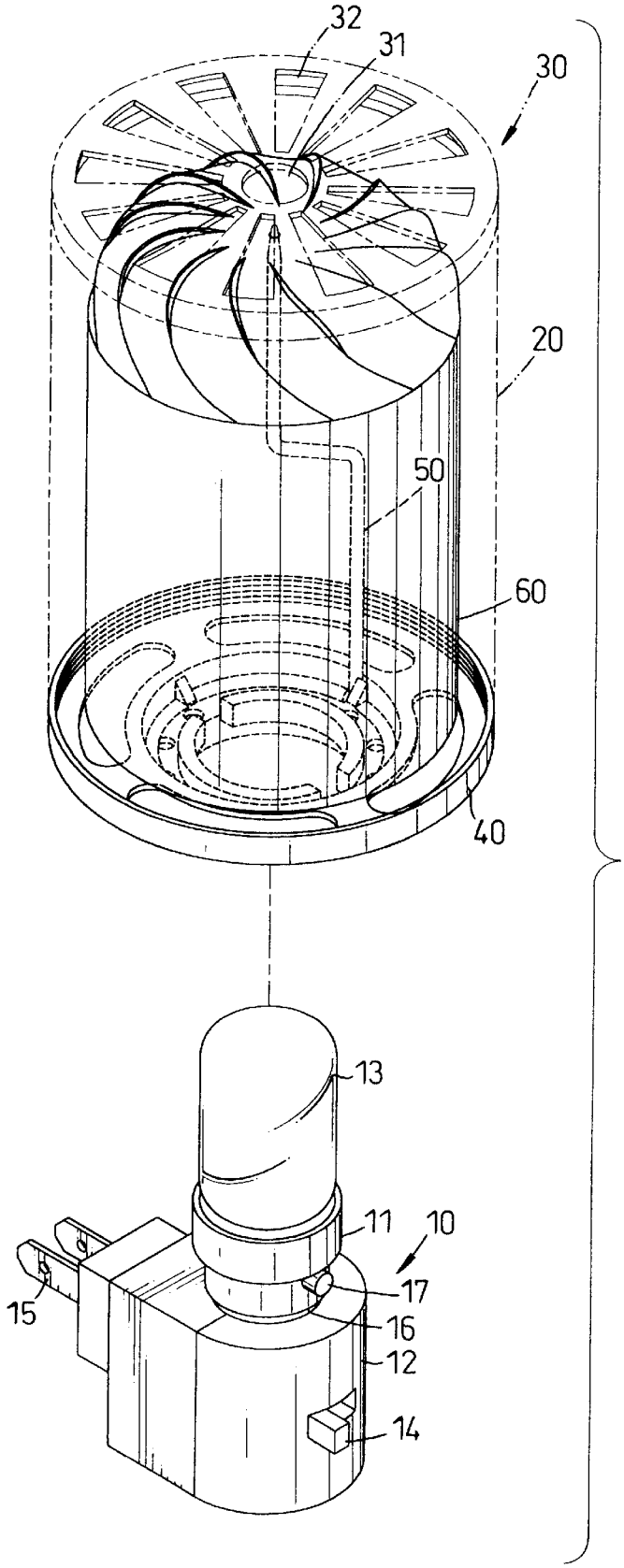
FIG. 1 is partially exploded perspective, view of a wall lamp in accordance with the present invention.
Figure 2:
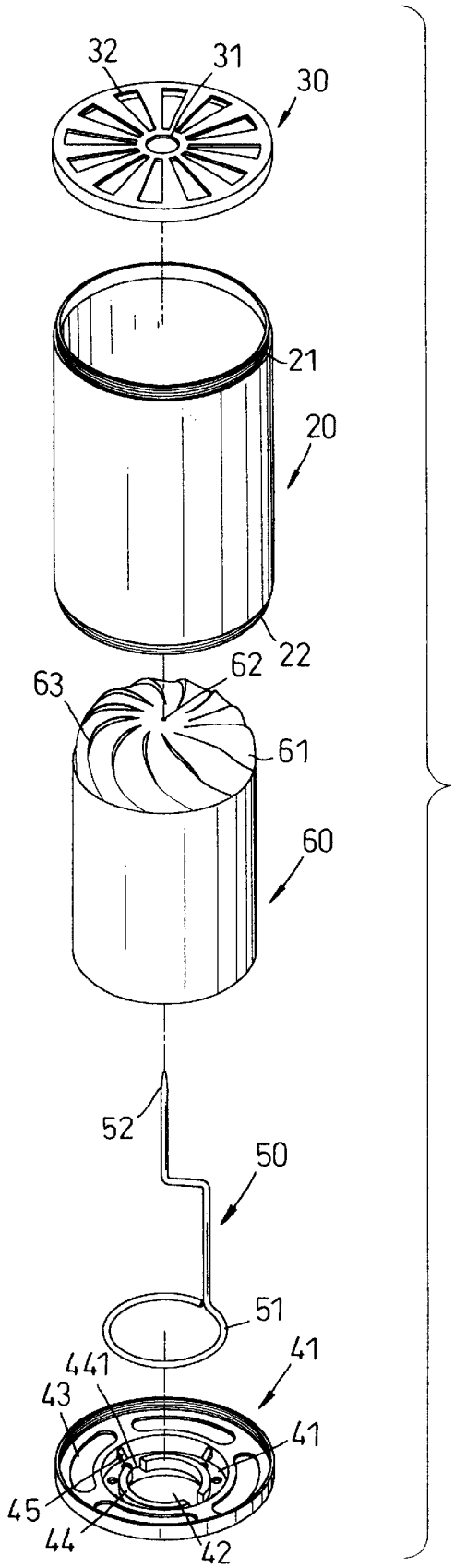
FIG. 2 is an exploded perspective view of the shade for the wall lamp in FIG. 1.

With reference to the drawings and initially to FIGS. 1 and 2, a wall lamp with a rotating inner shade in accordance with the present invention comprises a lamp body (10), a shade (20) and an inner shade (60). The shade (20) is attached to the lamp body (10). The inner shade (60) is rotatably mounted within the shade (20).

The lamp body (10) includes a housing (12) and a socket (11) extending upwardly from the housing (12). The socket (11) has a base and an open top. A light bulb (13) is electrically mounted in the open top of the socket (11). A switch (14) is mounted in the housing (12) and partially extends through the housing (12) so a user can selectively turn on the light bulb (13). Two prongs (15) are mounted in and extend from the housing (12) and are electrically connected to the switch (14). The two prongs (15) are adapted to be electrically connected to an electrical outlet. A groove (16) is defined around the base of the socket (11) and two stubs (17) laterally and diametrically extend from the socket (11) near the base.

The shade (20) is a cylinder. The shade (20) includes an upper end (21) and a lower end (22). An upper cover (30) is mounted on the upper end (21) of the shade (20), and a lower cover (40) is mounted on the lower end (22) of the shade (20). In the preferred embodiment of the present invention, the upper cover (30) and the lower cover (40) are screwed onto the shade (20). A through hole (31) is centrally defined in the upper cover (30), and multiple openings (32) are radially defined in the upper ,cover (30) relative to the through hole (31) in the upper cover (30). The lower cover (40) is circular, has a center and includes a circular groove (41) and a locking hole (42). The circular groove (41) is concentrically defined around the center of the lower cover (40) and has a bottom (not numbered) and an outer wall (not numbered). The locking hole (42) has an edge and is concentrically defined at the center of the lower cover (40) inside the circular groove (41). Multiple openings (43) are defined in the lower cover (40) around the circular groove (41). Two arcuate walls (44) with an exposed top extend up from the edge of the locking hole (42), and two gaps (441) are formed on diametrically sides of the locking hole (42) between the arcuate walls (44).

Figure 3:
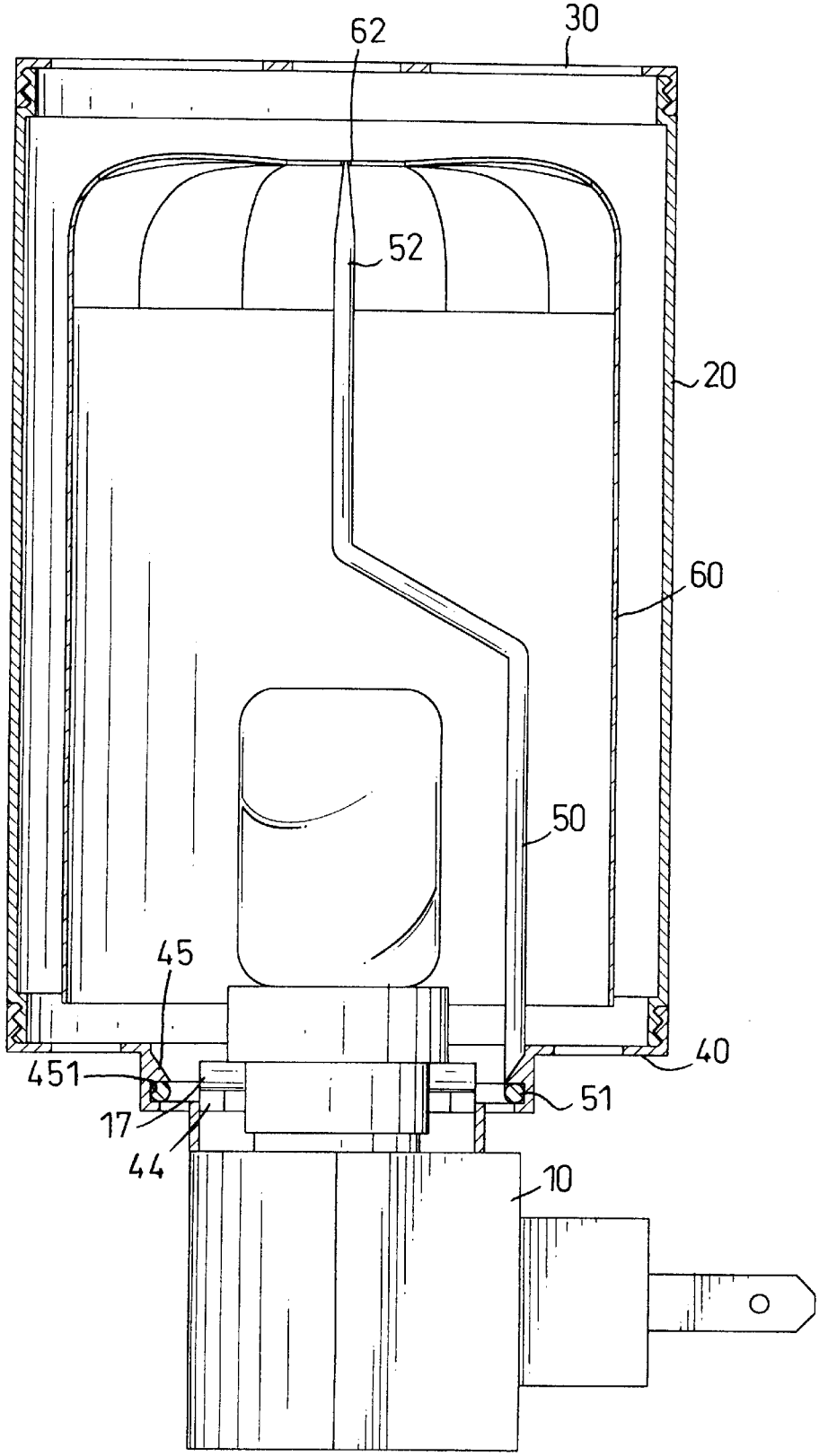
FIG. 3 is a side plan view in partial section of the wall lamp in FIG. 1.

To assemble the shade and the lamp body (10), the stubs (17) are passed up through the gaps (441) in the lower cover (40) and are turned to securely abut the top of each arcuate wall (44). Multiple retaining hooks (45) are formed on the outer wall of the circular groove (41) and extend radially and laterally into the circular groove (41). With further reference to FIG. 3, a recess (451) is formed between the bottom of the circular groove (41) and each retaining hook (45).

A stand (50) is perpendicularly attached to the lower cover (40). The stand (50) has a first end (not numbered) bent to form a ring (51) that is mounted in the recess (451) between the bottom of the circular groove (41) and each retaining hook (45), and a second end (not numbered) with a point (52).

The inner shade (60) is rotatably mounted on the point (52) of the stand (50). The inner shade (60) is a cylinder and has an open end (not numbered) facing the lower cover (40) and a closed end (not numbered). The inner shade (60) has a pinhole (62) centrally defined through the closed end of the inner shade (60). The pinhole (62) in the inner shade (60) has a diameter smaller than that of the stand (50) so that the inner shade (60) is balanced on the point (52) at the second end of the stand (50). The inner shade (60) has multiple blades (61)

radially formed on the closed end of the inner shade (60) and multiple passages (63) defined in the closed end of the inner shade (60) between adjacent blades (61).

Figure 4:
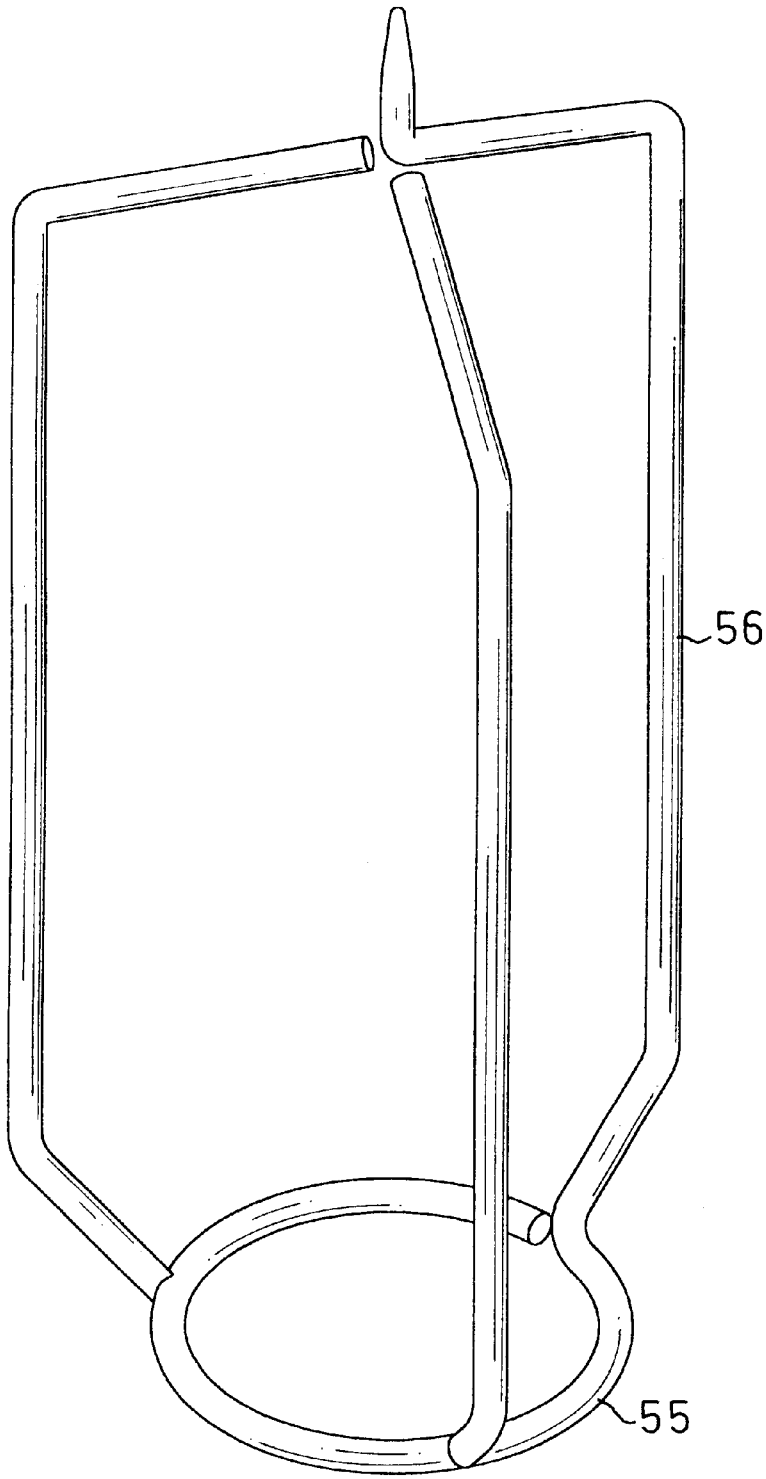
FIG. 4 is a perspective view of a second embodiment of a stand for the inner shade of the wall lamp in accordance with the present invention.
Figure 5:
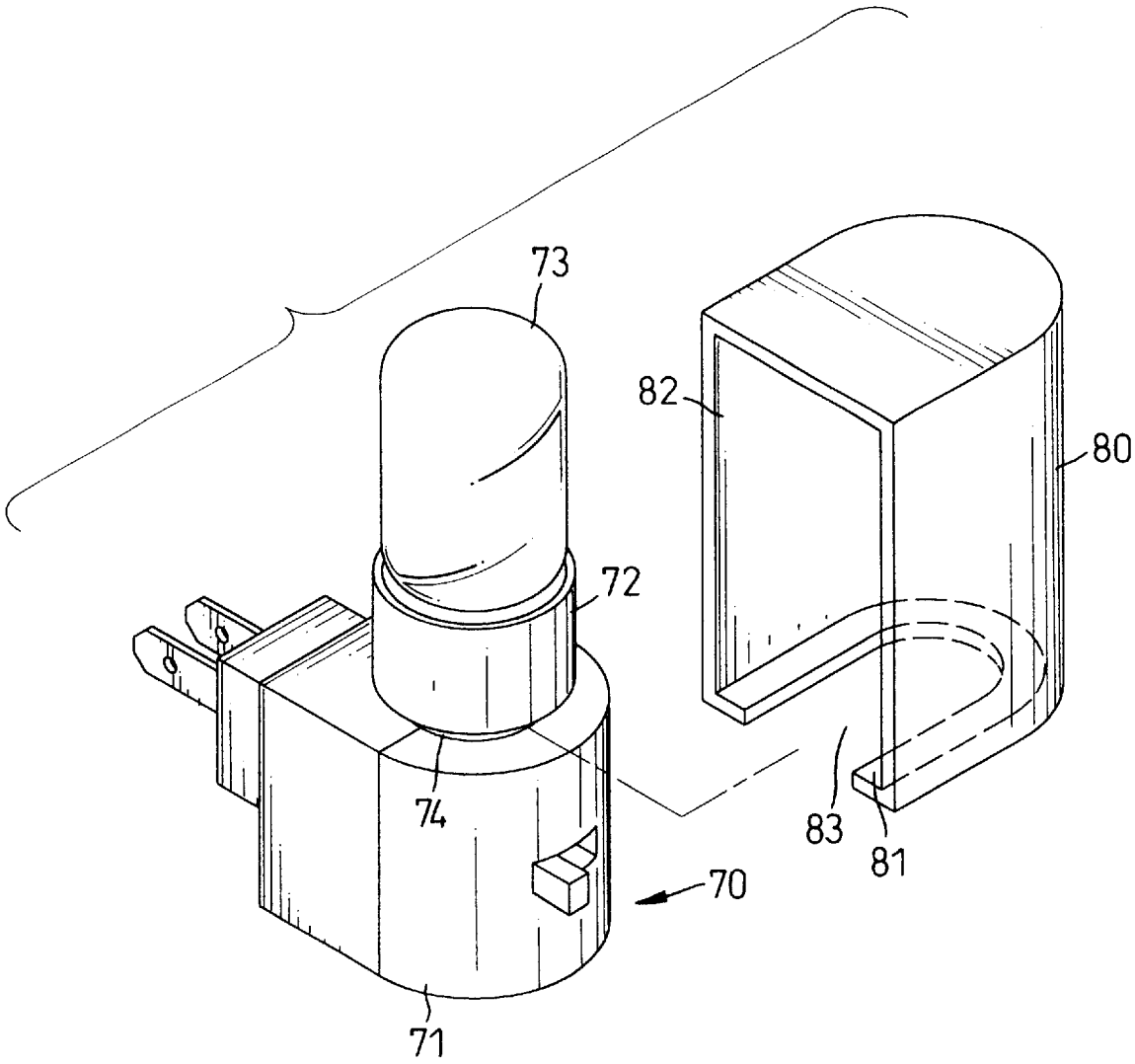
FIG.5 PRIOR ART
FIG. 5 is a partially exploded perspective view of a conventional wall lamp in accordance with the prior art.

With reference to FIG. 4, another embodiment of the stand (50) has an upper and lower end, a ring (55) formed on the lower end, multiple brackets (56) extending up from the ring (55) and a point (not numbered) formed on one of the brackets (56).

The wall lamp as described operates by hot air generated by the burning light bulb (13) rising in the inner shade (60). The hot air strikes the blades (61) and imparts a lateral force on the blades (61) that causes the inner shade (60) to rotate as the hot air passes through the passages (63). Consequently, the light radiating from the wall lamp in accordance with the present invention is more vivid than that of the,conventional wall lamp. Furthermore, the lower cover (40) is screwed onto the shade (20) and the lower cover (40) is mounted on the housing (12) by the stubs (17) securely abutting the arcuate walls (44) of the lower cover (40) such that the connection between the shade (20) and the housing (12) is much secure than that between the shade (80) and the housing (71) of the conventional wall lamp.

Although the invention has been explained in relation to its preferred embodiment, it is to be understood that many other possible modifications and variations can be made without departing from the spirit and scope of the invention as hereinafter claimed.

What is claimed is:

1. A wall lamp with a rotating inner shade, comprising:

a lamp body including a housing having a socket with a base and an open top extending upwardly from the housing to hold a light bulb, the housing including a switch mounted in the housing and partially extending through the housing for a user to selectively turn on the light bulb, and two prongs extending through the housing and adapted to be electrically connected to an electrical outlet;

and two stubs laterally and diametrically extending from the socket near the base;

a shade attached to the housing, the shade being a cylinder with an upper and lower end and including:

an upper cover mounted on the upper end of the shade and having multiple openings radially defined in the upper cover; and a lower cover mounted on the lower end of the shade, the lower cover being circular, having a center and including a circular groove concentrically defined around the center having a bottom and a vertical outer wall, a locking hole defined around the center within the circular groove having an edge, multiple openings defined in the lower cover around the circular groove, and two arcuate walls extending up from the edge of the locking hole and respectively supporting the stubs on the socket and two gaps formed on diametrically opposite sides of the locking hole between the arcuate walls for the stubs on the socket respectively extending through the gaps;

a stand attached to the lower cover, the stand with a first and second end having the first end bent to form a ring that is securely mounted in the circular groove in the lower cover and a point formed at the second end; and an inner shade rotatably mounted on the point at the second end of the stand, the inner shade being a cylinder and having an open end facing the lower cover and a closed end, the inner shade including:

a pinhole centrally defined through the closed end of the inner shade, the pinhole in the inner shade having a diameter smaller than that of the stand so that the inner shade is balanced on the point at the second end of the stand;

multiple blades radially formed on the closed end of the inner shade; and multiple passages defined in the closed end of the inner shade and between adjacent blades on the closed end of the inner shade.

2. The wall lamp as claimed in claim 1, wherein the lower cover further comprises multiple retaining hooks formed on the outer wall of the circular groove extending radially and laterally into the circular groove and a recess formed between the bottom of the circular groove and each retaining hook so that the ring of the stand is received in the recess and snapped between the retaining hooks and the bottom of the circular groove in the lower cover.

3. The wall lamp as claimed in claim 2, wherein the lower cover is screwed onto the lower end of the shade and the upper cover is screwed onto the upper end of the shade.

4. The wall lamp as claimed in claim 1, wherein the stand comprises multiple brackets extending up from the ring of the stand.

5. The wall lamp as claimed in claim 1 further comprising a groove defined around the base of the socket.

6. The wall lamp as claimed in claim 1, wherein the upper cover has a through hole centrally defined in the upper cover (30); and the openings are radially defined relative to the through hole in the upper cover.

* * * * *